US007186154B2

(12) United States Patent
Takashima et al.

(10) Patent No.: US 7,186,154 B2
(45) Date of Patent: Mar. 6, 2007

(54) SECURITY SYSTEM FOR WATERCRAFT

(75) Inventors: Sumihiro Takashima, Shizuoka (JP); Toshiyuki Hattori, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/862,823

(22) Filed: Jun. 7, 2004

(65) Prior Publication Data

US 2005/0003716 A1 Jan. 6, 2005

(30) Foreign Application Priority Data

Jun. 6, 2003 (JP) ..... 2003-161542

(51) Int. Cl.
*B63B 35/73* (2006.01)

(52) U.S. Cl. ..... 440/1; 114/55.51

(58) Field of Classification Search ..... 440/1; 114/55.51

See application file for complete search history.

(56) References Cited

U.S. PATENT DOCUMENTS

| | | | | |
|---|---|---|---|---|
| 4,162,449 | A * | 7/1979 | Bouyssounouse et al. | 455/521 |
| 4,853,504 | A | 8/1989 | Tanaka et al. | |
| 4,941,854 | A * | 7/1990 | Takahashi et al. | 440/1 |
| 5,319,698 | A | 6/1994 | Glidewell et al. | |
| 5,593,330 | A | 1/1997 | Kobayashi | |
| 5,623,245 | A | 4/1997 | Gilmore | |
| 5,725,228 | A | 3/1998 | Livingston | |
| 5,854,736 | A | 12/1998 | Fuhs et al. | |
| 5,860,842 | A * | 1/1999 | Parr | 441/80 |
| 6,077,133 | A | 6/2000 | Kojima et al. | |
| 6,125,782 | A | 10/2000 | Takashima et al. | |
| 6,352,045 | B1 | 3/2002 | Takashima | |
| 6,404,071 | B1 | 6/2002 | Kurano | |
| 6,695,657 | B2 | 2/2004 | Hattori | |
| 6,878,019 | B2 | 4/2005 | Kanno et al. | |
| 6,889,654 | B2 | 5/2005 | Ito | |
| 2002/0053310 | A1 * | 5/2002 | Ibata et al. | 114/55.53 |
| 2003/0089291 | A1 * | 5/2003 | Kanno et al. | 114/144 A |
| 2004/0198106 | A1 * | 10/2004 | Tsumiyama et al. | 440/1 |

FOREIGN PATENT DOCUMENTS

| | | |
|---|---|---|
| EP | 1 069 012 A2 | 1/2001 |
| JP | 2001-254549 | 9/2001 |

OTHER PUBLICATIONS

Photograph of Safety Lanyard Cap and Float from 2001 Seadoo RXDI.

SeaDoo 2003 shop Manual; pp. 1-7; @Bombardier Inc. 2003.

Copending U.S. Appl. No. 10/909,938, filed Aug. 2, 2004, entitled "Control Device for Small Watercraft".

* cited by examiner

*Primary Examiner*—Sherman Basinger
(74) *Attorney, Agent, or Firm*—Knobbe, Martens, OIson & Bear, LLP

(57) ABSTRACT

A watercraft has an engine that is controlled by an electronic control unit and the watercraft includes a security system. The security system comprises a portable transmitter and a mounted receiver. A predetermined mounting location on the watercraft of a receiver of the security system allows for improved serviceability and improved reception between the transmitter and a corresponding receiver.

13 Claims, 12 Drawing Sheets

SECURITY SYSTEM FOR WATERCRAFT

PRIORITY INFORMATION

This application is based on and claims priority to Japanese Patent Application No. 2003-161542, filed Jun. 6, 2003, the entire contents of which is hereby expressly incorporated by reference.

BACKGROUND OF THE INVENTION

The present invention generally relates to a control system and a method for controlling a marine engine, and more particularly relates to an improved control system and method that controls a marine engine using a command unit that includes a transmitter and a receiver.

DESCRIPTION OF THE RELATED ART

Automobiles in recent years have been provided with an automatic control system using a transmitter that can remotely communicate with a receiver on the automobile to allow an engine of the automobile to start. Typically, an ID code is applied to identify whether a transmitter is the true key that is accessible to an associated receiver. Unless the system determines that the ID code is true, the person who has tried to use the key is not allowed to start the engine.

The control system also can allow the driver of the automobile to lock or unlock door locks, a transmission lock, a steering lock of the automobile or to use devices such as, for example, a navigation device through the transmitter. If the transmitter and/or the receiver do not work properly, the driver can use an auxiliary device that allows the driver to operate the foregoing locks and/or the devices by inputting a password. Japanese patent publications Nos. 2004-42898 and 2003-327055 disclose examples of such automobile systems.

Small watercraft, like automobiles, also employ an engine to power the vehicle. For example, in a personal watercraft (PWC), a hull of the watercraft typically defines a rider's area above an engine compartment. An internal combustion engine powers a jet propulsion unit that propels the watercraft by discharging water rearward. The engine lies within the engine compartment in front of a tunnel, which is formed on an underside of the hull. At least part of the jet propulsion unit is placed within the tunnel and includes an impeller that is driven by the engine.

SUMMARY OF THE INVENTION

An aspect of the present invention involves the recognition that watercraft (e.g., personal watercraft) can be provided with similar engine control devices and systems to those applied to automobiles. The devices and systems, however, require specialized implementation in order to tolerate the operating conditions commonly experienced by personal watercraft. For instance, during operation of a personal watercraft, water from the body of water in which the watercraft is operating can enter the hull of the personal watercraft. The water, which can be saltwater, can adversely impact the ability of the receiver and shorten the life of the receiver if the water comes in prolonged contact with the receiver.

Furthermore, contrary to automotive applications, service may be required more frequently due to the wet environment in which a personal watercraft operates. Thus, mounting locations for the receiver preferably facilitate ease of access for servicing.

A need therefore exists for a control system and method for a watercraft that can protect the transmitter and receiver from prolonged water contact while enabling a consistent ability for the transmitter and receiver to communicate and facilitating servicing.

Thus, one aspect of the present invention involves a watercraft comprising a hull, a seat and a control mast. An engine is disposed within the hull. A controller communicates with at least one engine parameter and the controller being configured to control engine operation. A security system is configured to communicate with the engine controller. A receiver communicates with the security system. A portable transmitter transmits at least one signal to the receiver. The security system determines how the engine controller controls the engine in response to a signal received from the receiver. The receiver is located in a remote location above the water level of the watercraft and adjacent to an access opening.

Another aspect of the present invention involves a watercraft comprising a hull. A seat is positioned along a portion of the hull. An engine is positioned within the hull generally below the seat. An ECU communicates with the engine. A receiver communicates with the ECU and is mounted on a surface positioned within the hull. An opening is positioned proximate the surface. The receiver is positioned proximate the opening and the receiver is adapted to receive a signal from a portable transmitter.

Further aspects, features and advantages of this invention will become apparent from the detailed description of the preferred embodiments which follow.

BRIEF DESCRIPTION OF THE DRAWINGS

The foregoing features, aspects, and advantages of the present invention will now be described with reference to the drawings of several preferred embodiments that are intended to illustrate and not to limit the invention.

DETAILED DESCRIPTION OF THE PREFERRED EMBODIMENT

Figure 1:
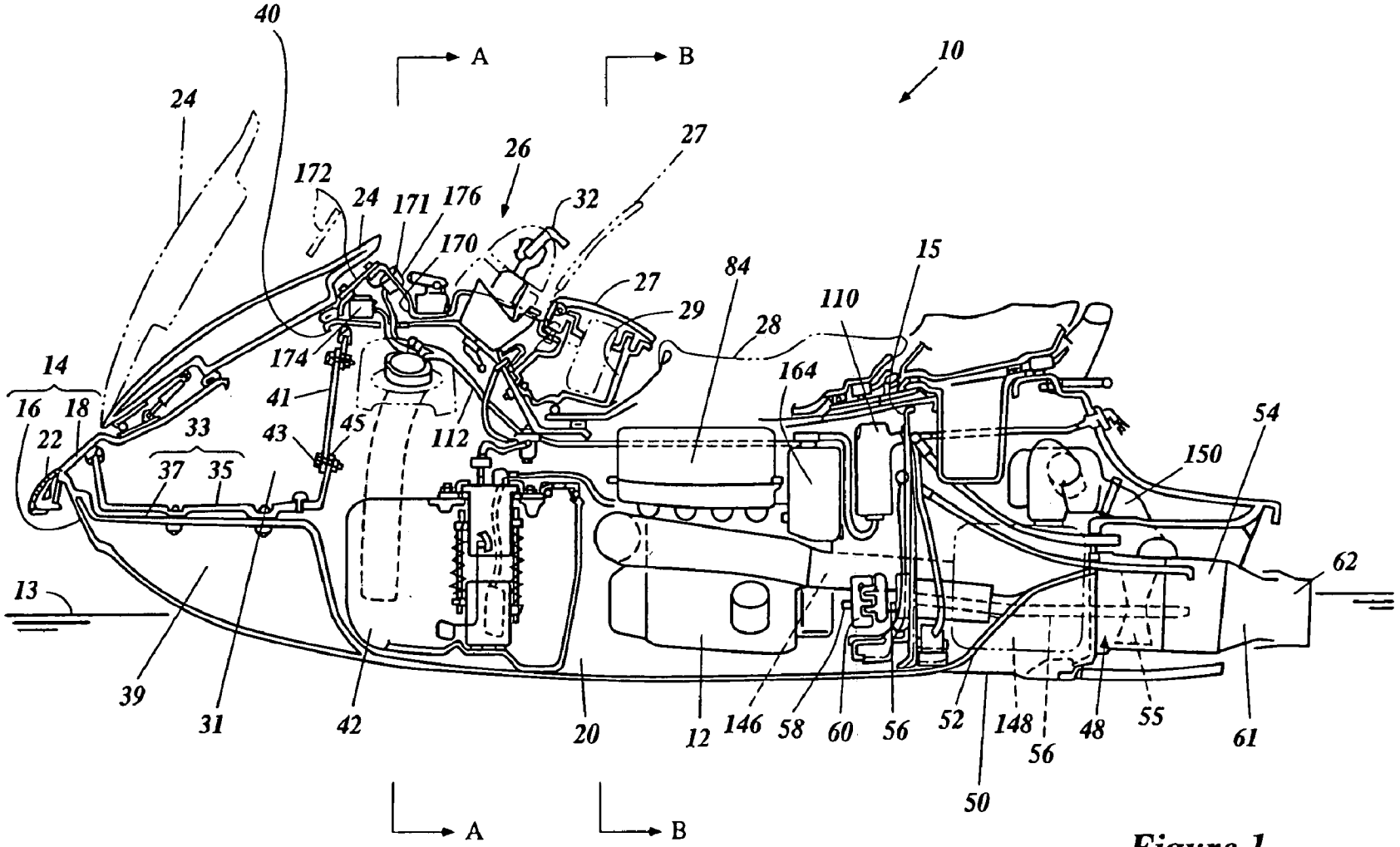
FIG. 1 is a side elevation and sectioned view of an engine-powered personal watercraft that has a security system comprising a receiver that is arranged and configured in accordance with certain features, aspects and advantages of the present invention.
Figure 2:
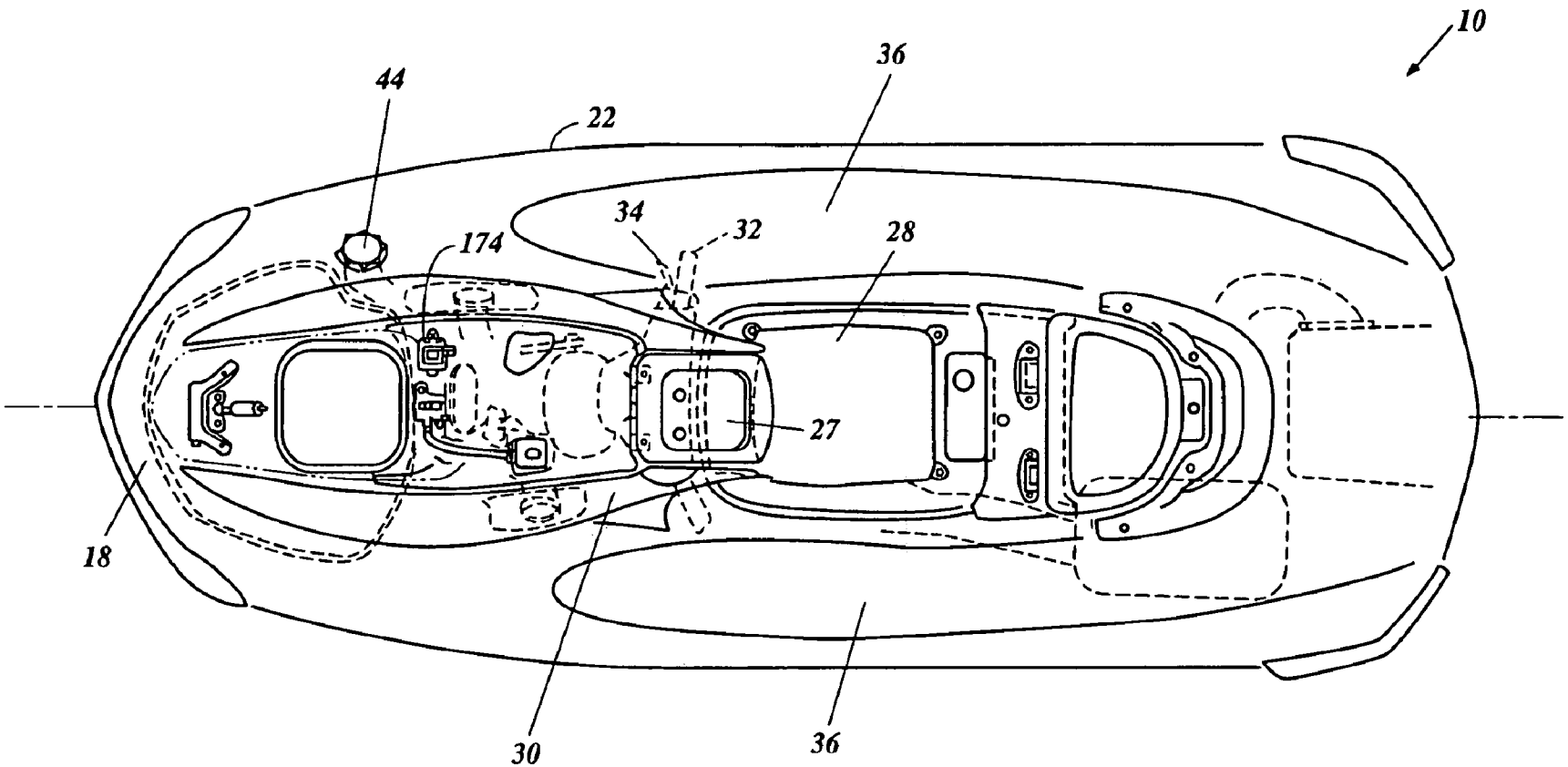
FIG. 2 is a top plan view of the watercraft of FIG. 1 with several of the internal components of the watercraft (e.g. a vent tube and front hatch cover) shown in phantom lines.
Figure 3:
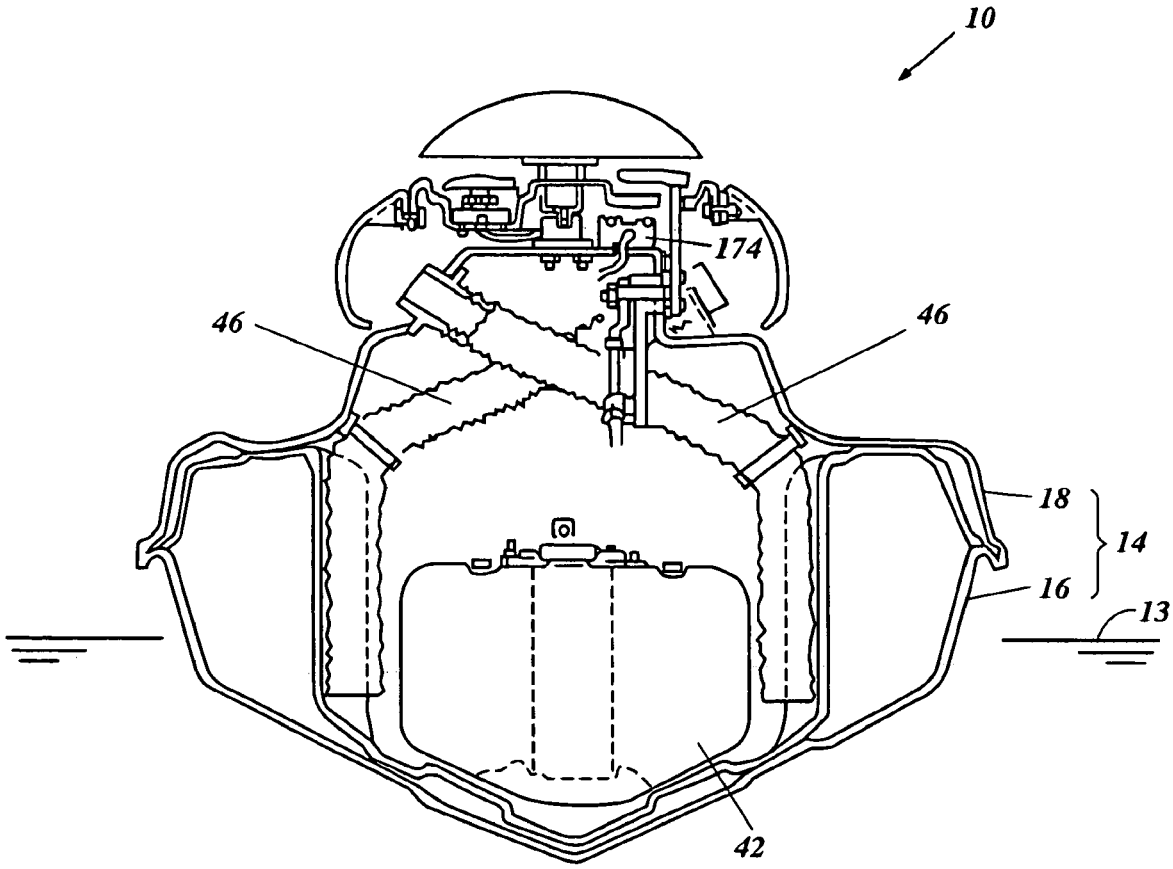
FIG. 3 is a front sectioned view of the watercraft of FIG. 1 taken along the line A—A of FIG. 1.

With reference to FIGS. 1 to 3, an overall configuration of an embodiment of a personal watercraft 10 will be described. The watercraft 10 advantageously employs a security system 11, which is configured in accordance with features, aspects and advantages of the present invention. The described security system configuration and the associated control routine have particular utility for use with personal watercraft, and thus, are described in the context of personal watercraft. The security system and the control routine, however, also can be applied to other types of watercraft, such as, for example, small jet boats and other vehicles.

With reference initially to FIG. 1, the personal watercraft 10 is designed to travel on a body of water 13. As such, the watercraft 10 includes a hull 14 formed with a lower hull section 16 and an upper hull section or deck 18. The lower hull section 16 and the upper hull section 18 preferably are coupled together to define an internal cavity 20. A bond flange 22 defines an intersection of both of the hull sections 16, 18.

The illustrated upper hull section 18 preferably comprises a hatch cover 24, a control mast 26, a smaller hatch cover 27, and a seat 28, which are arranged generally in seriatim from fore to aft. In the illustrated arrangement, a forward portion of the upper hull section 18 defines a bow portion 30 (FIG. 2) that slopes upwardly.

A forward bulkhead 33 is formed within the hull. Preferably, a storage compartment 31 is positioned proximate the forward bulkhead 33. In the illustrated arrangement, a lower surface 35 of the storage compartment 31 can rest on a generally horizontal surface 35 of the forward bulkhead 33. A downwardly sloping surface preferably is located rearward of the surface 35. A lower hull cavity 39 can be positioned generally beneath the forward bulkhead 33 and, more particularly, generally beneath the generally horizontal surface 35.

A maintenance opening 40 can be defined through a wall of the storage compartment 31. In one arrangement, the maintenance opening 40 is defined through a rear wall of the storage compartment. The opening 40 preferably is sufficiently large to allow maintenance of portions of the security system 11, which will be described in greater detail below. More preferably, the opening 40 is sufficiently large to allow the serviced components to be removed from the watercraft through the opening 40.

An opening can be provided through the bow portion 30 so the rider can access the internal storage compartment 31. An access lid 41 is securely attached through fasteners 43 to an upper support 45 of the storage compartment 31. The lid 41 is designed to close the opening 40. Preferably, the lid 41 seals or substantially seals the opening 40. More preferably, the lid 41 is capable of creating a substantially watertight seal over the opening 40. As discussed directly above, removal of the lid 41 allows access to a front portion of the internal cavity 20.

The hatch cover 24 can be detachably affixed or hinged to the bow portion 30 to cover the opening in the hull that provides access to the storage compartment 31 or the corresponding region of the watercraft. The smaller hatch cover 27 allows access to a second, smaller storage compartment 29 that lies generally between the control mast 26 the seat 28.

Figure 4:
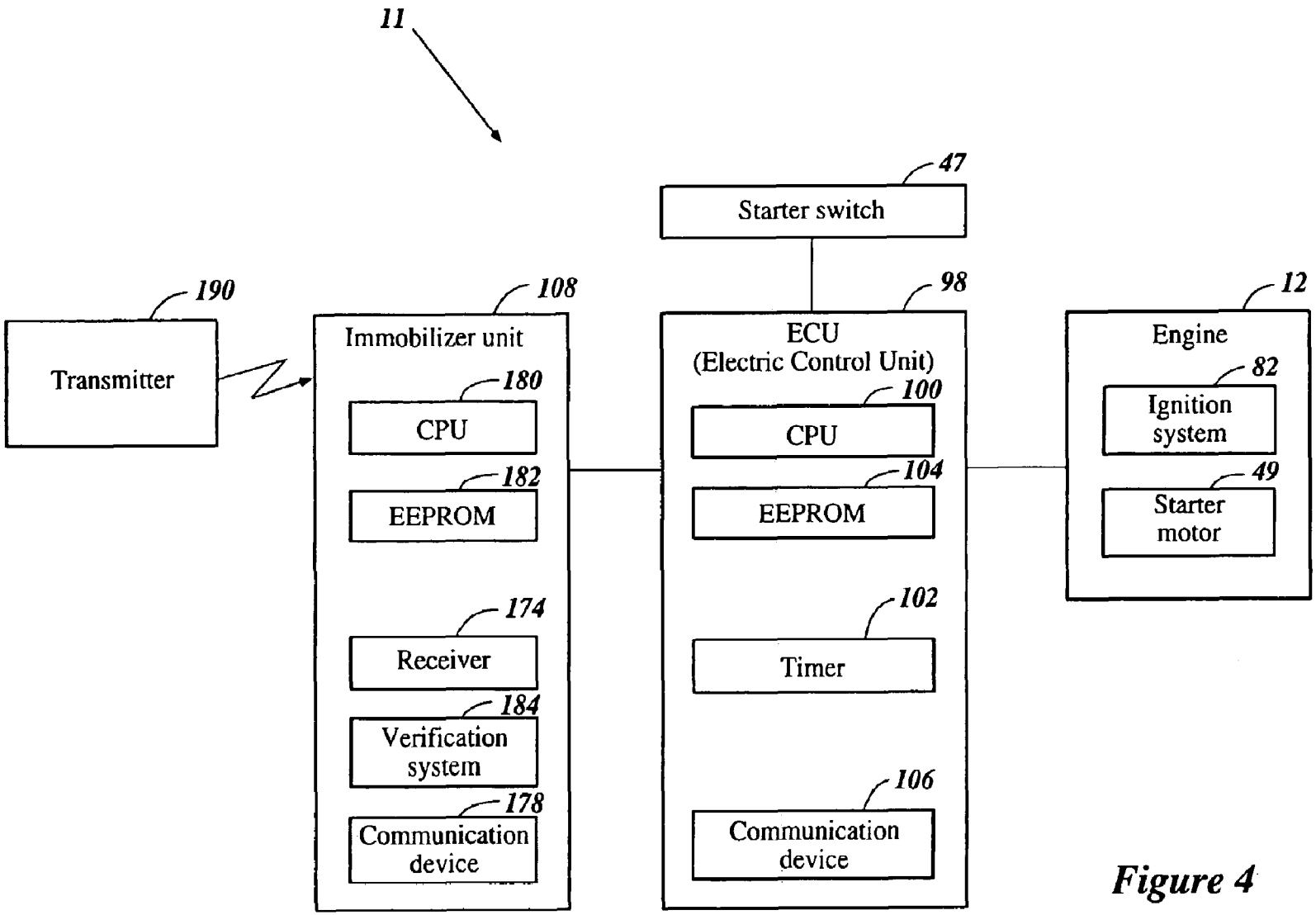
FIG. 4 is a block diagram of various electronic components of the personal watercraft including a transmitter, an immobilization unit, as well as an electronic control unit.

The control mast 26 extends upwardly to support a handle bar 32. The handle bar 32 is provided primarily for controlling the direction of the watercraft 10. The handle bar 32 preferably carries other mechanisms, such as, for example, a throttle lever 34 that is used to control the engine output (i.e., to vary the engine speed) and a starter switch 47 that is used to initiate a starter motor 49 (FIG. 4). The watercraft also can comprise a power switch, which energizes the electrical systems when turned on. Furthermore, a buzzer and a light can be provided such that the operator can hear the buzzer and see the light when the watercraft is ready for boarding and during operation. In some embodiments, an LED display can substitute for the light.

The seat 28 extends rearwardly from a portion just rearward of the bow portion 30. In the illustrated arrangement, the seat 28 has a saddle shape. Hence, a rider can sit on the seat 28 in a straddle fashion.

Foot areas 36 are defined on both sides of the seat 28 along a portion of the top surface of the upper hull section 18. The foot areas 36 are formed generally flat but may be inclined toward a suitable drain configuration.

A fuel tank 42 is positioned in the cavity 20 under the bow portion 30 of the upper hull section 18 in the illustrated arrangement. A duct (not shown) preferably couples the fuel tank 42 with a fuel inlet port positioned at a top surface of the bow 30 of the upper hull section 18. A closure cap 44 (FIG. 2) closes the fuel inlet port to inhibit water infiltration.

An engine 12 is disposed in an engine compartment defined, for instance within the cavity 20. The engine compartment preferably is located under the seat 28, but other locations are also possible (e.g., beneath the control mast or in the bow). In general, the engine compartment is defined within the cavity 20 by the forward bulkhead 33 and a rearward bulkhead 15. Other configurations, however, are possible.

A pair of air ducts 46 are provided in the illustrated arrangement such that the air within the internal cavity 20 can be readily replenished or exchanged. The engine compartment, however, is substantially sealed to protect the engine 12 and other internal components from water.

A jet pump unit 48 propels the illustrated watercraft 10. Other types of marine drives can be used depending upon the application. The jet pump unit 48 preferably is disposed within a tunnel 50 formed on the underside of the lower hull section 16. The tunnel 50 has a downward facing inlet port 52 opening toward the body of water. A jet pump housing 54 is disposed within a portion of the tunnel 50. Preferably, an impeller 55 is supported within the jet pump housing 54.

An impeller shaft 56 extends forwardly from the impeller and is coupled with a crankshaft 58 of the engine 12 by a suitable coupling device 60. The crankshaft 58 of the engine 12 thus drives the impeller shaft 56. The rear end of the housing 54 defines a discharge nozzle 61. A steering nozzle 62 is affixed proximate the discharge nozzle 61. The steering nozzle 62 can be pivotally moved about a generally vertical steering axis. The steering nozzle 62 is connected to the handle bar 32 by a cable or other suitable arrangement so that the rider can pivot the nozzle 62 for steering the watercraft.

The engine 12 in the illustrated arrangement operates on a four-stroke cycle combustion principal. The engine 12 is an inclined L4 (in-line four cylinder) type. The illustrated engine, however, merely exemplifies one type of engine on which various aspects and features of the present invention can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable. Many orientations of the engine are also possible (e.g., with a transversely or vertically oriented crankshaft).

The engine 12 preferably includes an air induction system to guide air to the engine 12. The illustrated air induction system includes an air intake box 84 for smoothing intake airflow and acting as an intake silencer. The intake box 84 in the illustrated embodiment is generally rectangular. Other shapes of the intake box of course are possible.

In one advantageous arrangement, an electronic control unit 98 (ECU, FIG. 4), such as a microcomputer, for example, is provided. The ECU 98 preferably comprises a micro-controller having a central processing unit (CPU) 100, a timer 102, and memory allocations. The memory allocations comprise at least an electrically erasable programmable read only memory (EEPROM) 104, however the memory allocations can also include, but are not limited to random access memory (RAM). Of course, other suitable configurations of the ECU 98 also can be used. Preferably, the ECU 98 is configured with or capable of accessing various maps to control engine operation in a suitable manner. The ECU 98 can also include a communication device 106 that allows for at least one way communication from an immobilizing unit 108 of the security system 11. The communication device 106 preferably comprises an interface that receives from and transmits to other devices connected to the ECU 98 data signals, including the security system 11, which will be described in greater detail below.

In the illustrated arrangement, the ECU 98 is advantageously housed in an electrical component box 110 and communicates through a cable 112 with various electrical devices including, but not limited to, the immobilizing unit 108 and electrical subsystems of the engine 12. The electrical component box 110 is preferably located behind the engine 12 underneath the seat 28. Although other locations for the electrical box 110 are possible, the location behind the engine 12 and underneath the seat 28 provides an area well protected from water intrusion.

The engine 12 also includes a fuel injection system which preferably includes four fuel injectors (not shown), each having an injection nozzle exposed to intake ports (not shown) so that injected fuel is directed toward combustion chambers (not shown). Thus, in the illustrated arrangement, the engine 12 features port fuel injection. It is anticipated that various features, aspects and advantages of the present invention also can be used with direct or other types of indirect fuel injection systems.

Fuel is drawn from the fuel tank 42 and delivered to the fuel injectors. Excess fuel that is not injected by the fuel injector returns to the fuel tank 42. In operation, a predetermined amount of fuel is sprayed into the engine 12 via the injection nozzles of the fuel injectors. The timing and duration of the fuel injection is dictated by the ECU 98 based upon any desired control strategy.

The engine 12 further includes an ignition system 82 (FIG. 4). In the illustrated arrangement, four spark plugs (not shown) are fixed on a cylinder head member (not shown). The spark plugs ignite an air/fuel charge just prior to, or during, each power stroke, preferably under the control of the ECU 98 to ignite the air/fuel charge therein.

The engine 12 further includes an exhaust system to discharge burnt charges, i.e., exhaust gases, from the Engine 12. An exhaust pipe 146 extends rearwardly along a port side surface of the engine 12. The exhaust pipe 146 is connected to a water-lock 148 proximate a forward surface of the water-lock 148. A discharge pipe 150 extends from a top surface of the water-lock 148. The discharge pipe 150 bends transversely across the center plane and rearwardly toward a stern of the watercraft. Preferably, the discharge pipe 150 opens at a stern of the lower hull section 16 in a submerged position. As is known, the water-lock 148 generally inhibits water in the discharge pipe 150 or the water-lock itself from entering the exhaust pipe 146.

The engine 12 further includes a cooling system configured to circulate coolant into thermal communication with at least one component within the watercraft 10. Preferably, the cooling system is an open-loop type of cooling system that circulates water drawn from the body of water in which the watercraft 10 is operating through thermal communication with heat generating components of the watercraft 10 and the engine 12. It is expected that other types of cooling systems can be used in some applications. For instance, in some applications, a closed-loop type liquid cooling system can be used to cool lubricant and other components.

The present cooling system preferably includes a water pump arranged to introduce water from the body of water surrounding the watercraft 10. The jet propulsion unit preferably is used as the water pump with a portion of the water pressurized by the impeller being drawn off for use in the cooling system, as is generally known in the art.

The engine 12 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 164.

In order to determine appropriate engine operation control scenarios, the ECU 98 preferably uses control maps and/or indices stored within the ECU 98 in combination with data collected from various input sensors. The ECU's various input sensors are not shown, however they can include, but are not limited to, a throttle position sensor, a manifold pressure sensor, an engine coolant temperature sensor, an oxygen ($O_2$) sensor, and a crankshaft speed sensor.

It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

During engine operation, ambient air enters the internal cavity 20 defined in the hull 14. The air is then introduced into the engine 12. At the same time, the fuel injectors spray fuel into the engine 12 under the control of ECU 98. Air/fuel charges are thus formed and delivered to the combustion chambers (now shown). The air/fuel charges are fired by the spark plugs under the control of the ECU 98. The burnt charges, i.e., exhaust gases, are discharged to the body of water surrounding the watercraft 10 through the exhaust system.

As discussed above, the watercraft desirably includes a security system 11. The security system can be at least partially positioned within a security compartment 170. In the illustrated arrangement of FIG. 1, the security compartment 170 is located directly underneath the upper rearmost portion of the hatch cover 24. More preferably, the security compartment is substantially closed by an access lid 172. Removal of the lid 172 after opening the hatch cover 24 provides access to the security compartment 170 through an access opening 171. The access lid 172 advantageously is hidden below the upper portion of the hatch cover 24 and can be removed, as indicated in dashed lines in FIG. 1.

A security system receiver 174 is mounted inside the security compartment 170 and, in the illustrated arrangement, is completely out of view when the hatch cover 24 is in both an open position and a closed position if the access lid 172 is in the mounted position. The location of the security system receiver 174 is meant to be out of view to inhibit unauthorized access to the security system receiver 174.

A wall of the security compartment 170 also advantageously can support various gauges of an instrument panel. In the illustrated embodiment, a portion of the security compartment supports, for example, a speedometer 176 but other gauges also can be supported. In some embodiments, (see, for example, FIGS. 9, 11 and 13) the speedometer 176 can be supported by a speedometer bracket 177.

With reference now to FIG. 4, the various electronic components of the watercraft, including components of the security system 11, are shown in a schematic block diagram. In the illustrated arrangement, the security system 11 comprises the immobilizing unit 108. The immobilizing unit 108 includes a communication device 178 that communicates with the communication device 106 inside the ECU 98. In one configuration, the immobilizing unit 108 also includes a CPU 180, an EEPROM memory allocation 182, the receiver 174, and a verification system 184. The verification system 184 is capable of determining if a transmitter 190 corresponds with the immobilizing unit 108. In some arrangements, the correspondence can involve a rolling access code while other arrangements use fixed signals.

When a transmitter 190 is within a predetermined distance range of the receiver 174, the receiver is able to receive signals from the transmitter 190. The signals sent by the transmitter 190 and received by the receiver 174 are further communicated with the immobilization unit 108. The immobilization unit 108 accordingly permits or prevents the engine 12 from being started. The immobilization unit 108 can also stop the engine 12 from operating if the engine 12 has already started and has been running. A control routine illustrated in FIG. 5 that explains the operation of the transmitter/receiver immobilization system will be described below.

Figure 5:
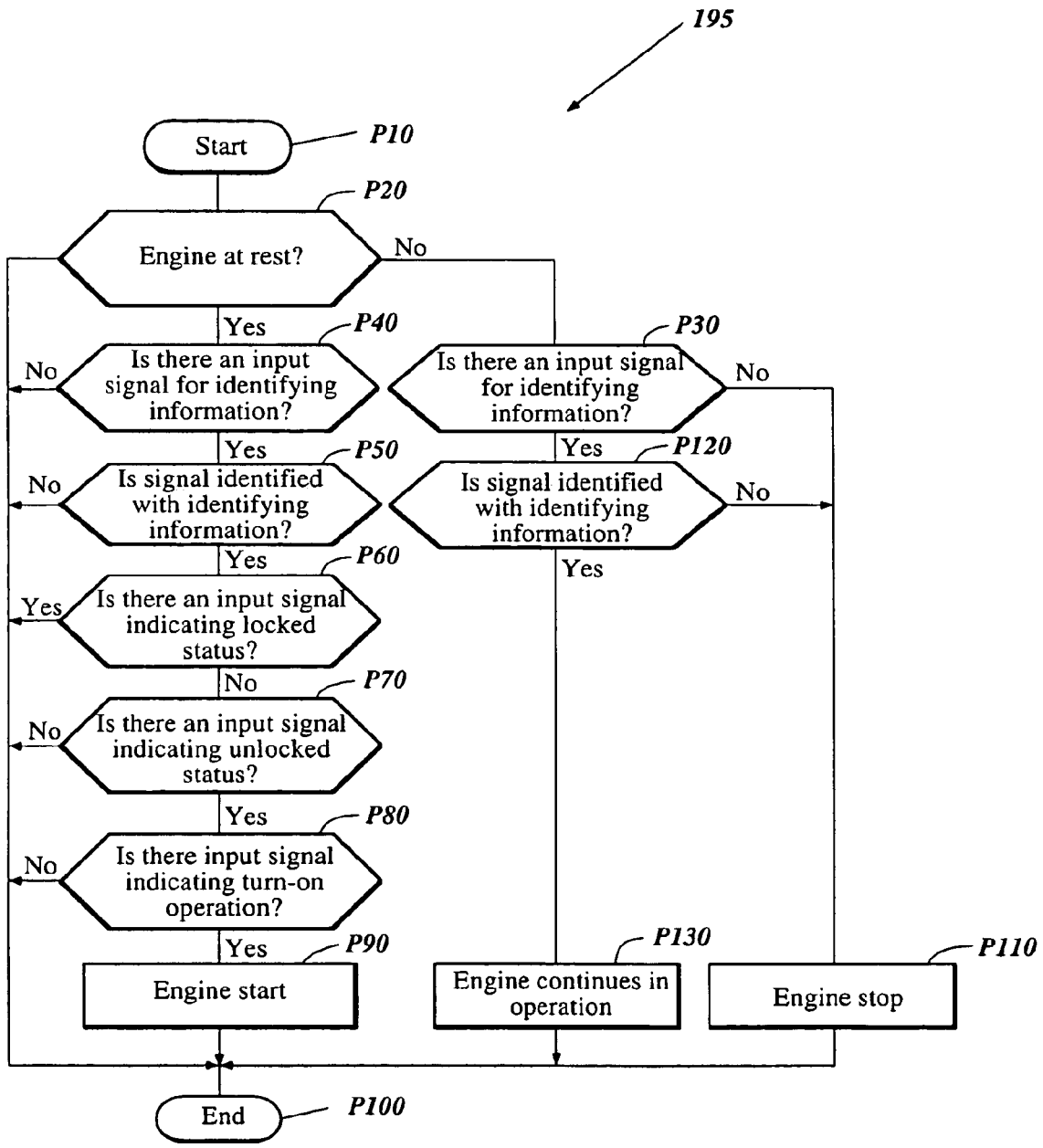
FIG. 5 is a flow diagram illustrating a control routine arranged and configured in accordance with certain features, aspects and advantages of the present invention.

With reference now to FIG. 5, a control arrangement 195 is shown that is arranged and configured in accordance with certain features, aspects, and advantages of the present invention. The control routine 195 is configured to control operation of the immobilizing unit of the watercraft security system.

As shown in FIG. 5, the control routine begins at an operation block P10 and moves to a first decision block P20. The routine 195 can start at any time. Preferably, the routine 195 is initiated when the transmitter 190 emits a signal that is recognized by the receiver 174. In some other arrangements, the routine is automatically begun, either intermittently or continuously. In yet other arrangements, the routine 195 can start as soon as a rider attempts to start the engine 12, for example, as soon as the start button is activated.

In the decision block P20, it is determined if the engine is at rest. In one embodiment, the determination is made by assessing whether a tachometer reading or tacho-signal has recently been sent from the engine to the ECU or not. If in decision block P20 it is determined that the engine is at rest, the control routine 195 proceeds to a decision block P40, where the routine checks for an identifying information input signal. For instance, when a person carrying the transmitter approaches the watercraft within the predetermined distance, the transmitter transmits the identifying information signal to the receiver, including, for instance, a rider's ID cord information. Until the identifying input signal is found, the routine ends at the operation block P100. The presence of the identifying information input signal can indicate that the transmitter 190 is within range of the receiver 174.

Assuming that the engine is at rest and the identifying information input signal is found (see P40), in decision block P50, the identifying information input signal is checked to determine if the identifying information input signal corresponds to the correct identifying information (see P50). If it is determined that the identifying information input signal does not correspond to the correct identifying information, the control routine 195 proceeds to the operation block P100 and ends. If, however, in decision block P50 it is determined that the identifying information input signal does correspond to the correct identifying information, the control routine 195 proceeds to a decision block P60.

In decision block P60, it is determined if there is a locked status input signal. A locked status input signal can correspond to a signal indicating that the engine cannot be operated. In one arrangement, the transmitter can have a button that can be used to select either a locked or unlocked state. If the locked state is selected, then the engine cannot be started and, if the unlocked state is selected, then the engine can be started. Thus, in decision block P60 the program determines whether or not there was an input signal indicating that the operator operated to the transmitter to select a locked mode.

If it is determined that there is a locked status input signal, the control routine proceeds to the operation block P100 where the control routine 195 ends. If, however, in decision block P60 it is determined that the locked status signal is not present, the control routine 195 proceeds to a decision block P70.

In decision block P70 it is determined if there is an input signal indicating an unlocked status. If it is determined that there is not an input signal that indicates an unlocked status, the control routine proceeds to the operation block P100 where the control routine 195 ends. If, however, in decision block P70 it is determined that the unlocked status signal is present, the control routine 195 proceeds to a decision block P80. In some arrangements, either decision block P60 or P70 can be omitted with an assumption that the absence of one signal indicates the presence of the other. One such arrangement assumes a locked condition unless an unlocked signal is present. In the illustrated arrangement, however, without an affirmative unlock signal, the engine will not operate, which reduces the likelihood of unauthorized use.

In decision block P80, it is determined if there is a turn on operation input signal. In most embodiments, the turn on operation input signal would result from operation of the starter button (e.g., a button that can be depressed by a rider to initiate engine operation). If it is determined that there is not a turn on operation signal present, the control routine proceeds to the operation block P100 where the control routine 195 ends. If, however, in decision block P80 it is determined that there is a turn on operation input signal present, the control routine 195 proceeds to an operation block P90 where the engine is started. The control routine then proceeds to the operation block P100 where the control routine 195 ends.

Returning again to decision block P20, if the engine is determined to be running then, in decision block P30, the routine looks for the identifying information input signal. If it is determined that there is no identifying information input signal, the control routine 195 proceeds to an operation block P110 where the engine is stopped. The immobilizing unit can stop operation of the engine or prevent starting of the engine through the ignition system of through the fuel injectors. The control routine then proceeds to the operation block P100 where the control routine ends. If, however, in decision block P30 it is determined that there is an identifying information input signal, the control routine 195 proceeds to a decision block P120.

In decision block P120, the identifying input signal is analyzed to determine if the signal being received matches the information stored in memory. If it is determined that the information matches, the engine continues operating (see P130). If it is determined that the identifying input signal does not match the information stored in memory, then the engine is stopped (see P110). The control routine then proceeds to operation block P100 where the control routine 195 ends.

Figure 6:
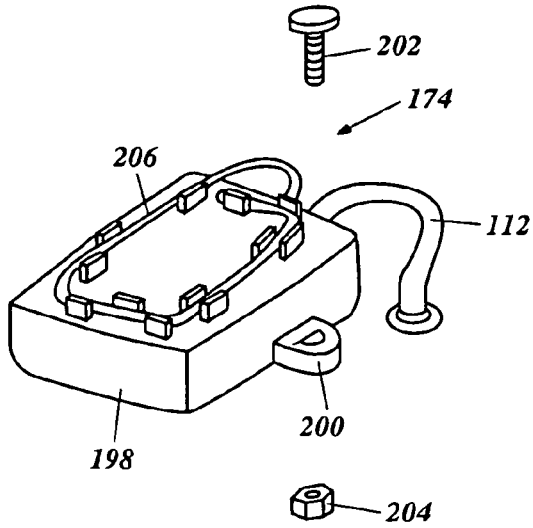
FIG. 6 is a perspective view of a receiver comprising a receiver housing and an antenna.

FIG. 6 illustrates a receiver housing 198 that advantageously can be mounted to any of a number of possible locations on the watercraft 10. The receiver housing 198 can have any suitable configuration. One possible configuration is the illustrated box-like configuration. A circuit board can be contained within the housing 198 and the housing 198 can be configured to be substantially watertight, if desired.

The illustrated receiver housing 198 also has two mounting bosses 200 (one shown) that allow small bolts 202 (or other suitable mechanical fastener) to pass through the mounting bosses 200 and attach the receiver housing 198 to the various predetermined locations on the watercraft 10. The small bolts 202 can be secured to the receiver housing 198 and the watercraft 10 with corresponding nuts 204. Other possibilities of securing the receiver housing 198 to the watercraft 10 are also possible. For instance, rivets, mechanical interlocking structures and the like can be used.

The cable 112 allows the receiver to communicate with the immobilizing unit 108. An antenna 206 is advantageously routed on the receiver housing 198 to allow an extended length of the antenna to be neatly positioned on the receiver housing 198. The extended length of the antenna 206 allows for improved reception and therefore improved communication between the receiver 174 and the transmitter 190. The neat position of the antenna 206 prevents the antenna from possibly tangling with other wires or becoming caught in one of the access lids. In one arrangement, the antenna 206 can be formed as a square, a rectangle, a circle or another suitable closed loop. Other configurations, however, may be practicable. Moreover, the looped configuration of the illustrated antenna 206 advantageously improves an omnidirectional characteristic of the antenna. Other arrangements capable of reducing the directional characteristic of the antenna and enhancing the omnidirectional characteristic also can be used. A directional antenna is practicable but the directional characteristic is presently less desired. Regardless of the construction of the antenna, the antenna preferably is positioned away from any instruments and watercraft components that might adversely affect transmission of radio waves to the receiver (e.g., an electric bilge pump).

Figure 7:
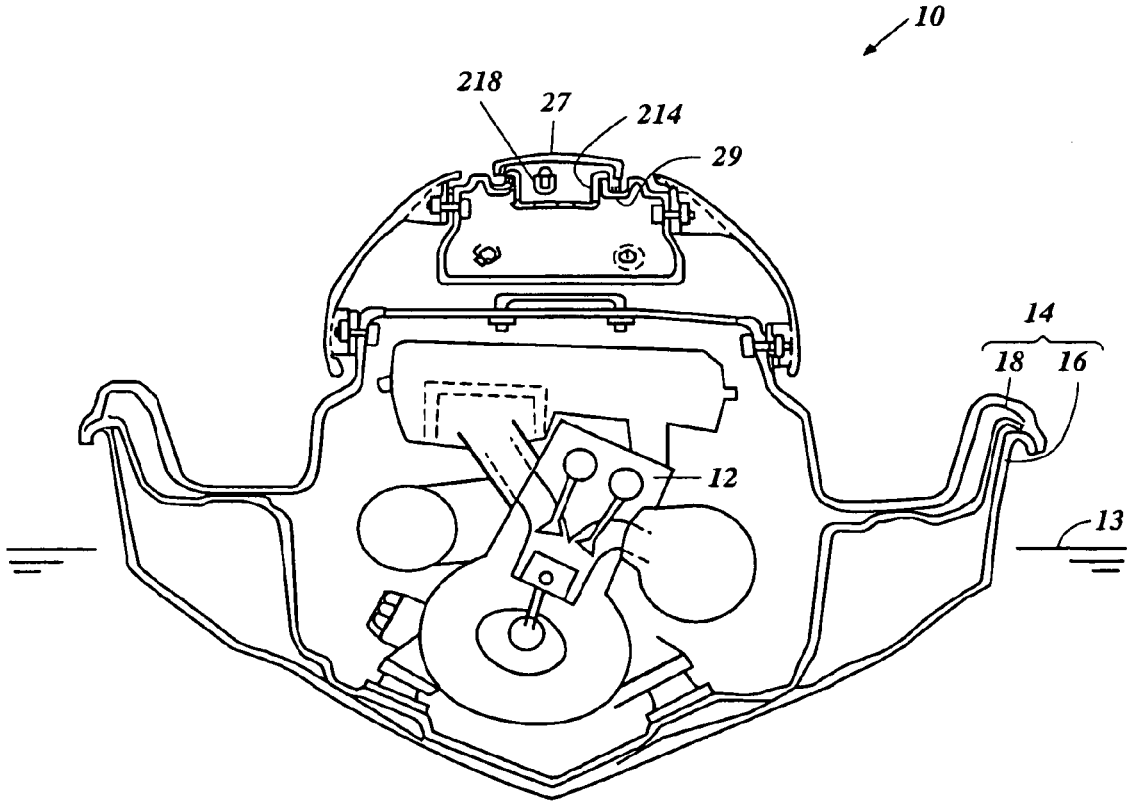
FIG. 7 is a front sectioned view of another watercraft similar to the watercraft of FIG. 1 and taken along a line corresponding to the line B—B of FIG. 1, which view illustrates another embodiment that is arranged and configured in accordance with certain features, aspects and advantages of the present invention.

FIG. 7 illustrates a sectioned side view of the watercraft 10 and the small storage compartment 29 located between the seat 28 and the control mast 26. The lid 27 covers the small storage compartment 29 and generally inhibits or substantially prevents water from entering the small storage compartment 29. In any event, the lid 27 can be used to decrease the likelihood of water entering the small storage compartment 29.

Figure 8:
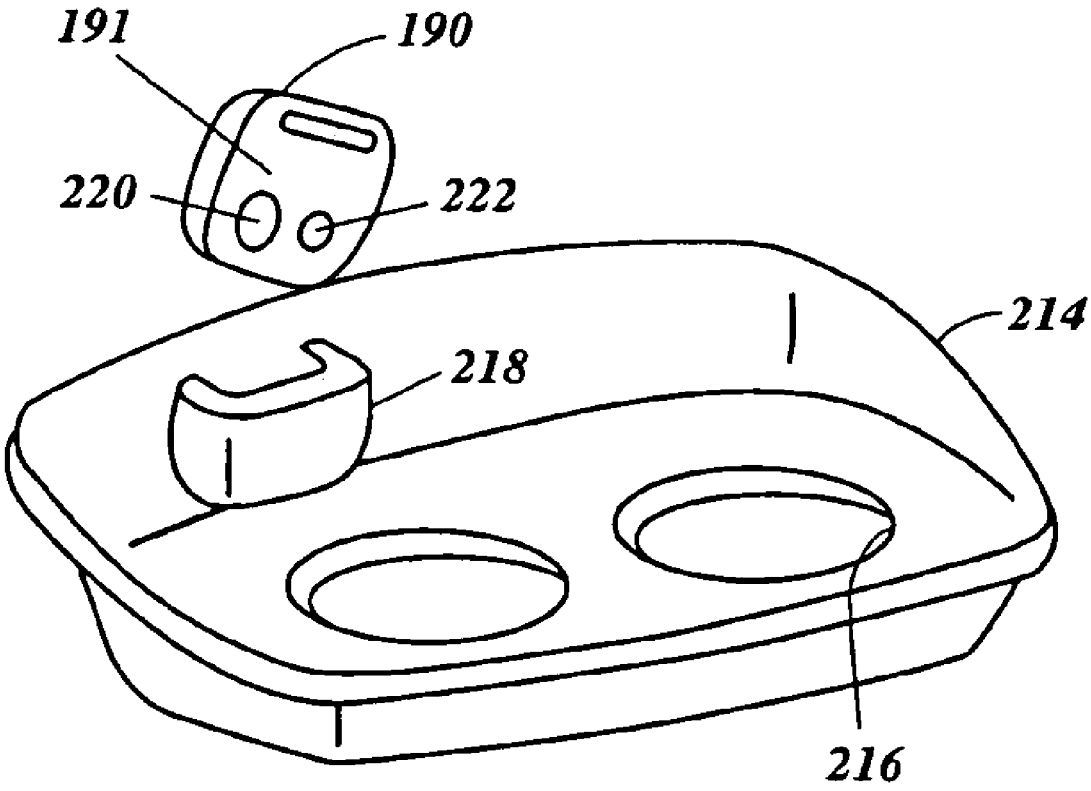
FIG. 8 is a perspective view of a cup holder for use with a personal watercraft, for instance, that has a receptacle configured to hold a portable transmitter.

A cup holder 214, such as that shown in FIG. 8, can have at least one receptacle 216 for securing a generally cylindrical container such a cup, a can, or a bottle. Of course, the containers are rarely completely cylindrical. The cup holder 214 preferably defines an insertable component that can be placed in the small storage compartment 29. The cup holder 214 can also include a holder 218 that can advantageously secure the transmitter 190. For example, the operator can store the transmitter 190 in the holder 218 during watercraft operation or while the watercraft 10 is being stored. The holder 218 allows for an allocated place inside the small storage compartment 29 for the transmitter to prevent misplacing the transmitter 190.

The illustrated transmitter 190 preferably comprises an outer housing 191. The outer housing 191 can have any suitable outer configuration. In the illustrated arrangement, the outer housing 191 is generally box-like. The outer configuration preferably is sized and configured to be securely held in the holder 218. The housing 191 preferably has an enclosed hollow space and/or is made of a low-density material (e.g., lower than the body of water in which the vehicle is being operated). In one arrangement, the housing is made of a low-density resin material and contains a hollow space. Thus, the transmitter 190 preferably is designed to float in the event it is dropped into a body of water.

Within the outer housing 191, the transmitter preferably comprises storage for storage information and a suitable mechanical structure for broadcasting at least some of the stored information. Thus, the transmitter contains any suitable transponder technology that allows the transmitter and the receiver to communicate when they are less than a predetermined distance from each other. In a sense, the terms transmitter and receiver are likely too narrow but it should be understood from the description herein that the receiver also may be able to transmit information that is received by the transmitter.

As discussed above, one arrangement of the transmitter comprises a lock button 220 and an unlock button 222. When the receiver 174 and the transmitter 190 have established communication with each other, i. e., the identifying information input signal transmitted from the transmitter 190 has been identified by the receiver 174 according to the control routine 195, the transmitter can send lock and unlock signals. For example, after the transmitter 190 and the receiver have established communication with each other, the operator can push the lock button 220. Pushing the lock button 220 communicates to the receiver that the engine 12 cannot operate, i.e. the engine 12 cannot be started or cannot continue to operate if the engine is already running. In one arrangement, when the lock button 220 is pressed, the ECU disables the engine in any suitable manner, the buzzer makes a first sound (e.g., a long uninterrupted sound) and the LCD makes a first visual confirmation (e.g., flashes once).

After the transmitter 190 and the receiver have established communication with each other, the operator can also push the unlock button 222. Pushing the unlock button 222 communicates to the receiver that the engine 12 can operate, i.e. the engine 12 can be started or can continue to operate if the engine is already running. In one arrangement, when the unlock button 222 is pressed, the ECU allows the engine to start, the buzzer makes a second sound (e.g., a pair of short interrupted sounds) and the LCD makes a second visual confirmation (e.g., flashes twice).

Figure 9:
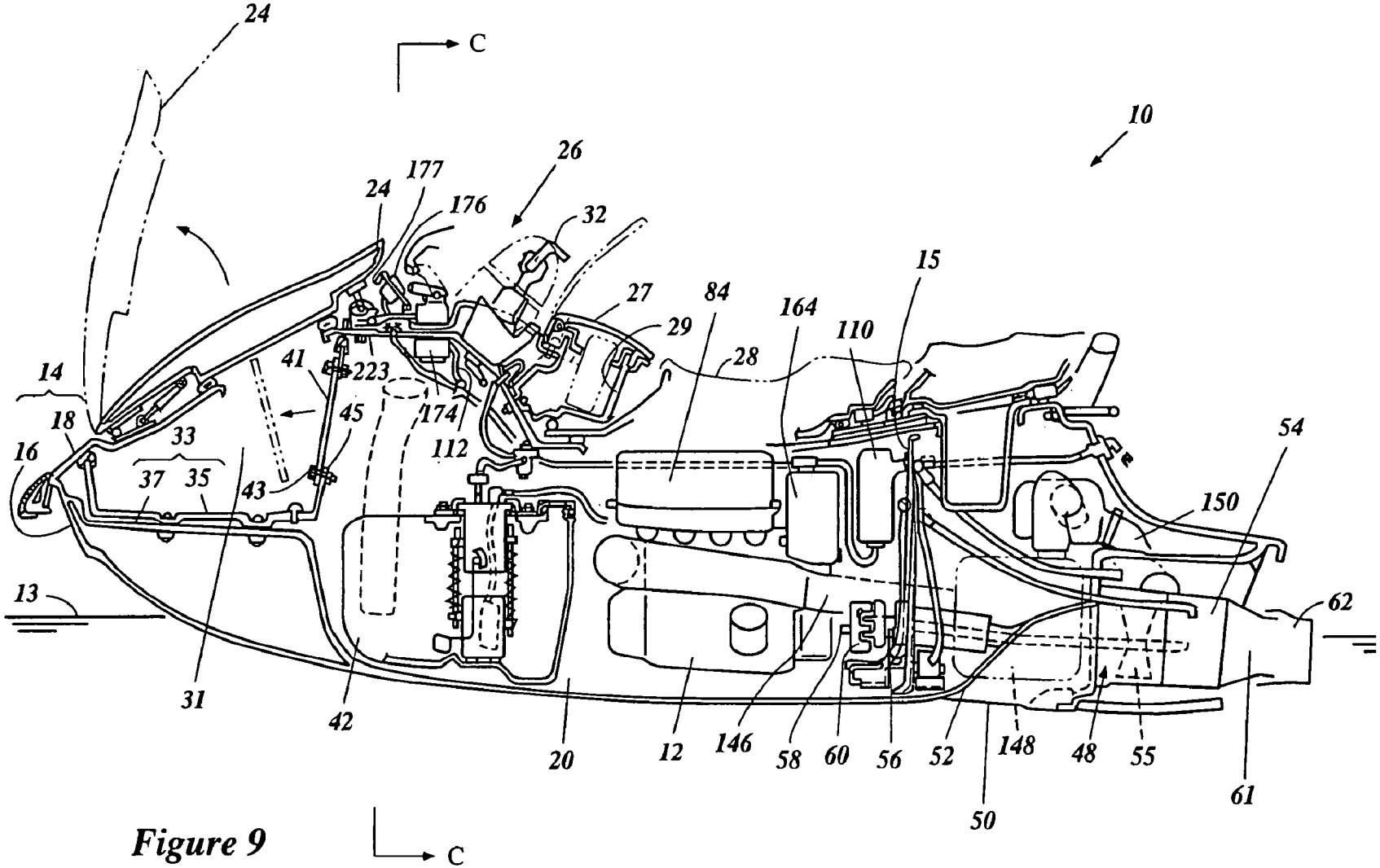
FIG. 9 is side elevation and sectioned view of another engine-powered personal watercraft comprising another embodiment of a security system that is arranged and configured in accordance with certain features, aspects and advantages of the present invention.
Figure 10:
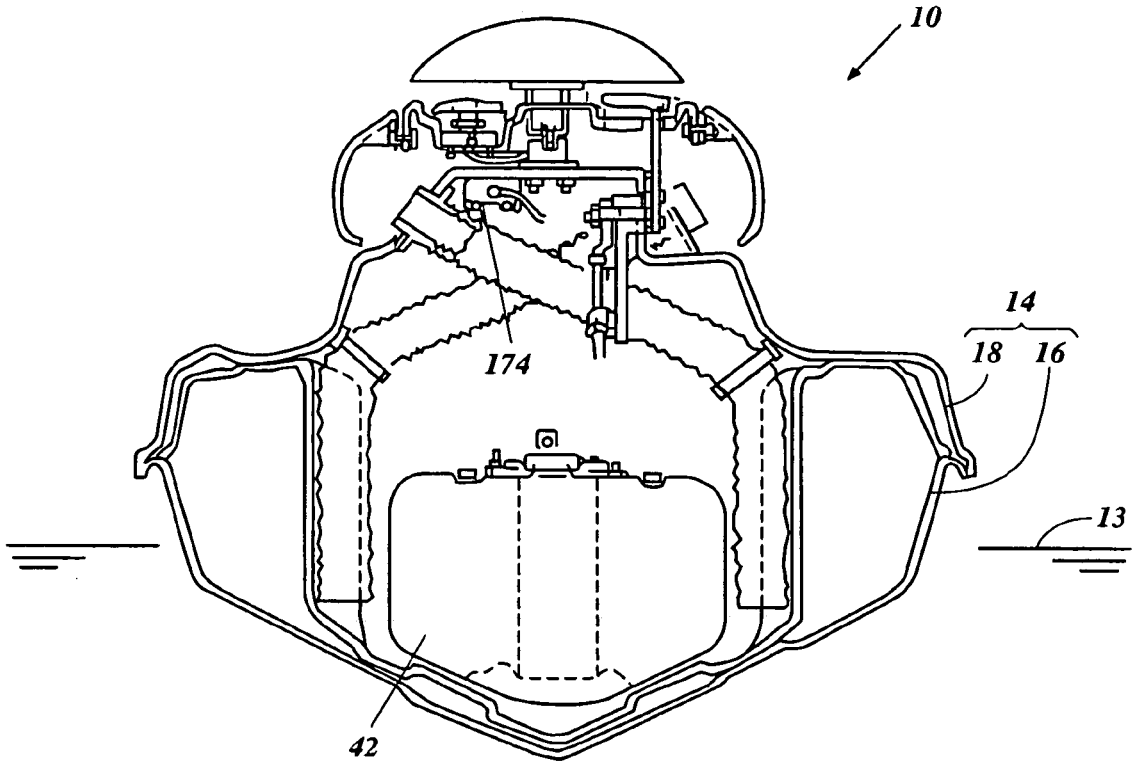
FIG. 10 is a front sectioned view of the watercraft of FIG. 9 taken along the line C—C of FIG. 9.

FIGS. 9 and 10 illustrate another preferred embodiment of the present invention. While the basic construction of the watercraft is the same as that described above, the receiver 174 can be inconspicuously positioned below the control mast 26 and mounted to an inside upper surface 223 of the hull 14 in a location that allows accessibility for service by removing the access lid 41 (shown with dashed lines in FIG. 9). The inconspicuous location of the receiver 174 is meant to be out of view to inhibit impermissible access to the security system receiver 174. As described above, the receiver 174 communicates with the immobilizing unit 108 through the cable 112.

With the construction illustrated in FIGS. 9 and 10, the receiver 174 is positioned within the engine compartment, which typically is fairly protected from water. Moreover, the receiver is positioned on a downwardly facing surface. As such, any water that might be present in the engine compartment is not likely to contact the receiver 174. This construction, therefore, admits to a receiver 174 that is not necessarily enclosed in a housing that is substantially water resistant.

Figure 11:
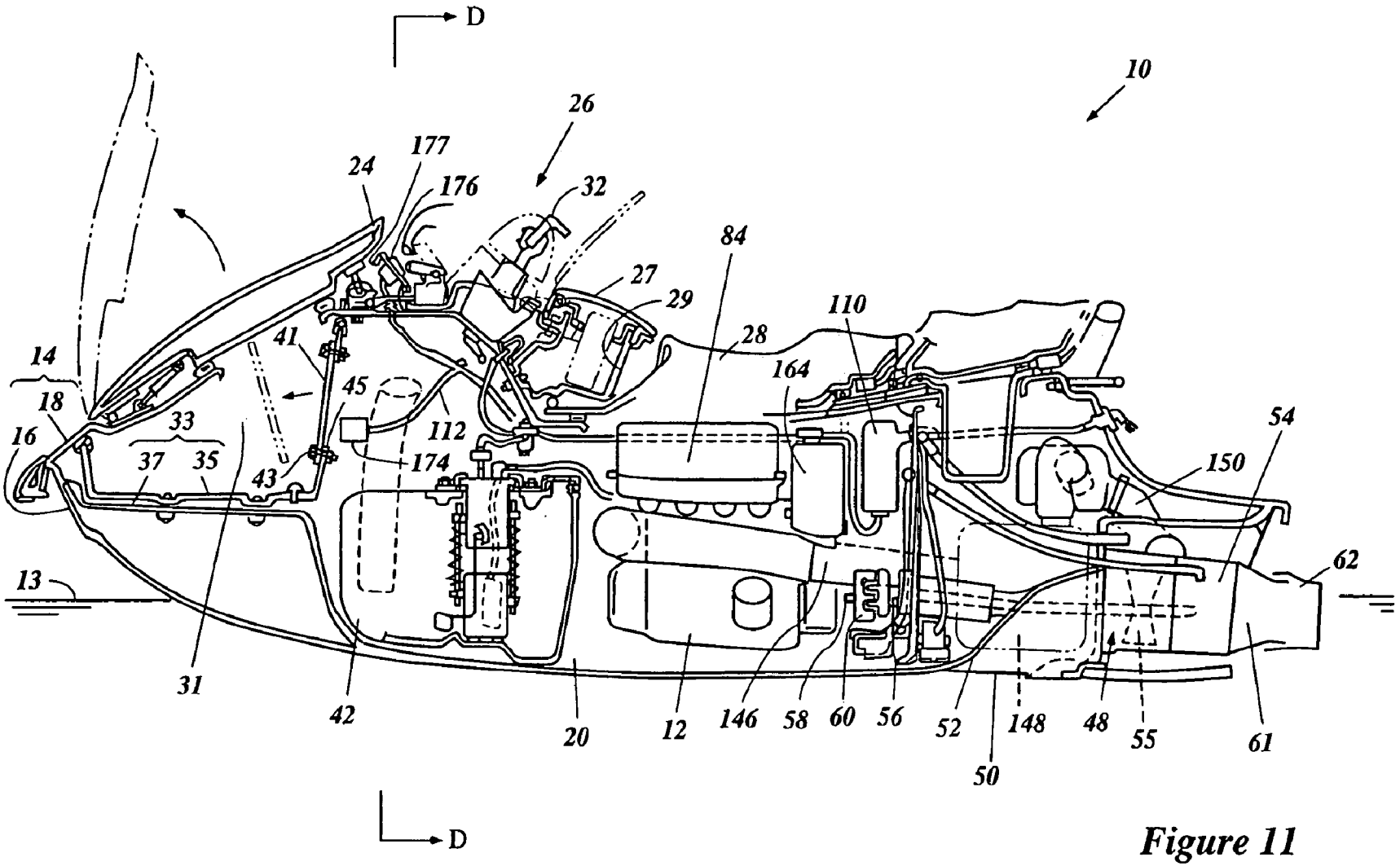
FIG. 11 is a side elevation and sectioned view of another engine-powered personal watercraft comprising another embodiment of a security system that is arranged and configured in accordance with certain features, aspects and advantages of the present invention.
Figure 12:
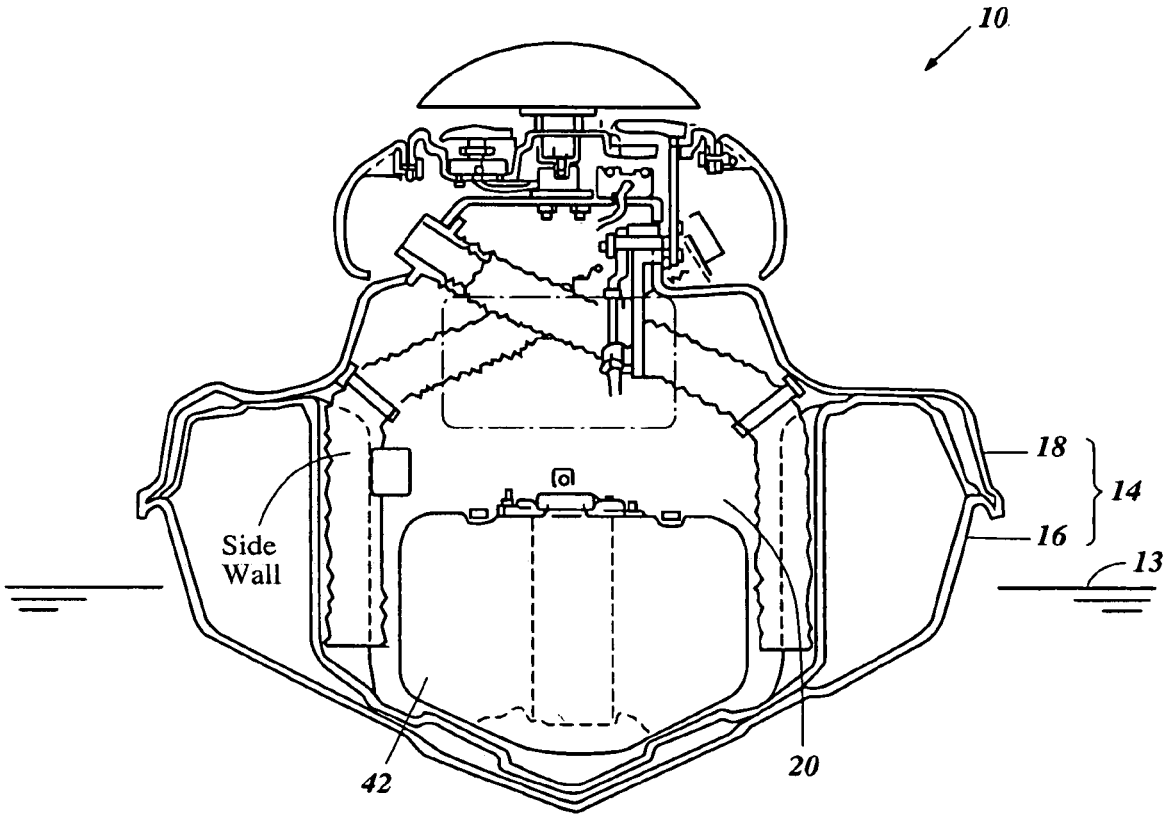
FIG. 12 is a front sectioned view of the watercraft of FIG. 11 taken along the line D—D of FIG. 1.

With reference to FIGS. 11 and 12, another preferred embodiment of the present invention is shown. In this arrangement, the receiver 174 can be inconspicuously positioned on a side wall 224 of the hull 14. Accessibility for service of the receiver 174 is achieved by removing the access lid 41. The inconspicuous location of the receiver 174 is meant to be out of view to inhibit impermissible access to the security system receiver 174. As described above, the receiver 174 communicates with the immobilizing unit 108 through the cable 112.

Figure 13:
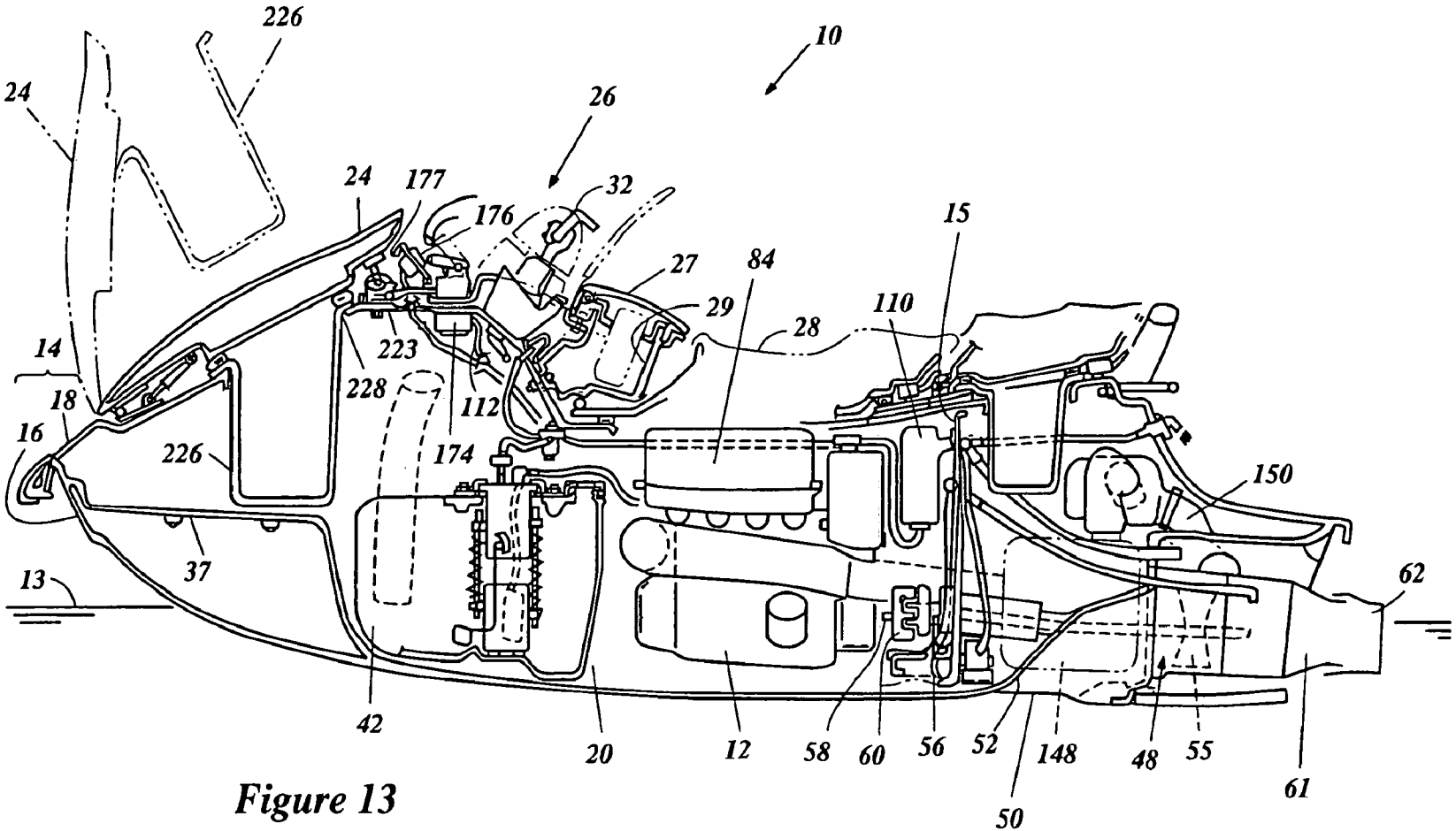
FIG. 13 is a side elevation and sectioned view of another engine-powered personal watercraft comprising another embodiment of a security system that is arranged and configured in accordance with certain features, aspects and advantages of the present invention.

FIG. 13 illustrates another preferred embodiment of the present invention. In this embodiment, the watercraft 10 can be constructed to include a removable storage container 226 instead of or in addition to the storage compartment 31 that is illustrated in FIGS. 1, 9, and 11. The receiver 174 can be inconspicuously positioned below control mast 26 in a location that allows accessibility for service by removing the removable storage container 226. The removable storage container 226 is positioned within an access hole 228. The removable storage container 226 is advantageously positioned between the hatch cover 24 and the access hole 228. The installed removable storage container 226 advantageously seals itself against the hatch cover 24 and the access hole 228 to inhibit water from entering the internal cavity 20. The inconspicuous location of the receiver 174 is meant to be out of view to inhibit impermissible access to the security system receiver 174. As described above, the receiver 174 communicates with the immobilizing unit 108 through the cable 112.

In another embodiment of the present invention, the transmitter 190 can directly communicate with the immobilizing circuit 108 through the cable 112 and the receiver 174 can be designed to be a portable device carried by the operator. The receiver can incorporate the lock button 220 and the unlock button 222 and communicate with the transmitter 190 to lock or unlock the operation of the engine 12. The receiver can also be positioned in the holder 218. The operator can store the receiver 174 in the holder 218 during watercraft operation or while the watercraft 10 is being stored. The holder 218 can allow for an allocated place inside the small storage compartment 29 for the receiver to prevent misplacing the receiver 174.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In addition, while the transmitter constantly transmits to the receiver in some embodiments discussed above, arrangements are also possible in which the transmitter is simply used for locking and unlocking and the routine does not continually check for a signal from the transmitter. Further, in some arrangements, the engine will start automatically once the correct transmitter is brought within range and, in some embodiments, the unlock button is pressed. Moreover, not all of the features, aspects and advantages are necessarily required to practice the present invention. Accordingly, the scope of the present invention is intended to be defined only by the claims that follow.

What is claimed is:

1. A watercraft comprising a hull, a seat, a control mast, an engine disposed within the hull, a controller communicating with at least one engine parameter, the controller configured to control engine operation, a security system configured to communicate with the engine controller, a receiver communicating with the security system, and a portable transmitter transmitting at least one signal to the receiver, the security system determining how the engine controller controls the engine in response to a signal received from the receiver, the receiver being located in a remote location relative to the controller, the remote location being located in a substantially water-tight region of the watercraft at a location above a resting water level of the watercraft and adjacent to an access opening into the substantially water-tight region of the watercraft.

2. The watercraft of claim 1, wherein the signal sent by the transmitter is a signal prohibiting engine operation.

3. The watercraft of claim 1, wherein the signal sent by the transmitter is a signal permitting engine operation.

4. The watercraft of claim 1, wherein the transmitter is buoyant.

5. The watercraft of claim 1, wherein the receiver is located vertically lower than a handlebar that forms a portion of the control mast.

6. The watercraft of claim 1, wherein the receiver is located in front of the control mast.

7. The watercraft of claim 1, wherein the receiver has an antenna that extends from the receiver.

8. The watercraft of claim 1, wherein the transmitter is removably mounted to the watercraft and the transmitter communicates by radio waves with the receiver.

9. The watercraft of claim 1 further comprising a removable lid closing the access opening.

10. The watercraft of claim 9, wherein the access opening is positioned generally above the receiver and forms an outer surface of the watercraft.

11. The watercraft of claim 1, wherein at least one gauge is mounted to a surface of a compartment.

12. The watercraft of claim 1, wherein at least a portion of at least one gauge extends into a compartment.

13. The watercraft of claim 1 further comprising a deck hatch, the deck hatch being pivotally connected to the hull and at least a portion of the deck hatch overlying the receiver.

* * * * *